United States Patent [19]

Morrison et al.

[11] 4,029,723

[45] June 14, 1977

[54] EVAPORATIVE AIRCONDITIONER

[76] Inventors: Terrence Keith Morrison; Brian Eric McLaren, both of P.O. Box 156, Buronga, N. S. W. 2648, Australia

[22] Filed: Oct. 18, 1976

[21] Appl. No.: 733,404

Related U.S. Application Data

[63] Continuation of Ser. No. 618,242, Sept. 30, 1975, abandoned.

[30] Foreign Application Priority Data

Sept. 30, 1974 Australia ..... 9073/74

[52] U.S. Cl. ..... 261/29; 261/103; 261/DIG. 15; 261/DIG. 41; 261/DIG. 43; 220/4 F; 220/324

[51] Int. Cl.² ..... F24F 3/14

[58] Field of Search ..... 261/29, 102, 103, 105, 261/106, DIG. 11, DIG. 15, DIG. 41, DIG. 43, DIG. 44; 220/4 R, 4 F, 7, 62, 77, 324

[56] References Cited

UNITED STATES PATENTS

| | | | |
|---|---|---|---|
| 42,355 | 4/1864 | Deroe | 220/77 |
| 43,371 | 6/1864 | Prince | 220/77 |
| 1,987,881 | 1/1935 | Von Seggern et al. | 261/DIG. 44 |
| 2,631,021 | 3/1953 | Arnold | 261/29 |
| 2,827,270 | 3/1958 | Martin | 261/DIG. 44 |
| 3,063,766 | 11/1962 | Goettl | 220/4 R |
| 3,231,247 | 1/1966 | Goettl | 220/62 |
| 3,261,493 | 7/1966 | Smith | 220/4 F |
| 3,290,020 | 12/1966 | Findley | 261/29 |
| 3,809,278 | 5/1974 | Csumrik | 220/4 F |
| 3,904,066 | 9/1975 | Wilson | 220/7 |

*Primary Examiner*—Tim R. Miles
*Assistant Examiner*—Gregory N. Clements
*Attorney, Agent, or Firm*—Cushman, Darby & Cushman

[57] ABSTRACT

The invention provides an evaporative airconditioner comprising a base, side panels and a top and wherein the side panels are supported on the base and have stiles having mitred side edges and wherein adjacent side panels abut and close sides of the airconditioner.

A water trough for delivering to the side panels is also used and is an annulus of U-shaped section and is received in complementary formations in the upper ends of the side panels to stabilize those panels and be itself supported by the side panels.

Clips may additionally secure the side panels together.

The base may include a first platform for air blower means, a second perimetric, platform for the lower ends of the side panels, a perimetric flange to restrict outward movement of the side panels and a water sump.

The top may include a perimetric flange to restrict outward movement of the tops of the panels.

The airconditioner can have certain standard parts modified so as to be side, top or bottom delivery.

7 Claims, 18 Drawing Figures

EVAPORATIVE AIRCONDITIONER

This is a continuation, of application Ser. No. 618,242 filed Sept. 30, 1975, now abandonded.

BACKGROUND OF THE INVENTION

1. FIELD OF THE INVENTION

This invention relates to articles and methods.

In a particular aspect this invention relates to evaporative airconditioners, parts therefor and means of constructing same.

One object of this invention is to provide an evaporative airconditioner which is simply constructed from standard parts and which may be supplied in top, bottom or side delivery form.

In a particular aspect it is an object of the invention to provide an evaporative airconditioner not having the usual frame to which side panels are secured so that economics in construction and in particular saving of labour costs may be obtained.

SUMMARY OF THE INVENTION

The present invention provides an evaporative airconditioner comprising a base, side panels and a top and wherein the side panels are supported on the base and have stiles having mitred side edges and wherein adjacent side panels abut and close sides of the airconditioner.

The present invention also provides a side panel for an evaporative airconditioner, the side panel having stiles the side edges of which are mitred whereby to enable a number of such panels to be located in abutment to, in use, close sides of the airconditioner.

For large size airconditioners the sides thereof may be comprised of two or more of the side panels and in this instance mullions having mitred side edges may be located between adjacent side panels along one side of the airconditioner.

Side panels will generally carry water absorbent material through which air will be drawn to be cooled by evaporation of the water. In an alternative, a side panel may have duct means whereby that side panel may serve as a delivery panel for a side delivery airconditioner. To enable a choice to be made it is preferred that each side panel comprises two stiles and a bottom rail; a top rail being provided by means dependent on whether water absorbent material or side delivery means are to be carried. In another construction the side panels are made as a single piece.

The upper ends of the side panels and a perimetrically extending water trough for supplying water to at least some of the side panels are preferably complementarily formed so that the trough will stabilize the upper ends of the side panels which will in turn stabilize the trough. One of the side panels may not be so complementarily formed so that it may be removed without disturbing the trough.

A preferred formation of the upper ends of the side is U-shaped for receiving the trough.

Clip means are preferably provided for clipping the mitred side edges together thereby to stabilize the side panels with respect to one another. Particularly suitable clips are U-shaped or C-shaped and locate in slots in the upper ends of the side panels.

The base for the airconditioner preferably comprises a platform located above the bottom thereof adapted to support airblower means and the platform may be adapted to be apertured whereby the base may serve as a delivery panel for a bottom delivery airconditioner. Similarly, the top may serve as a delivery panel for a top delivery airconditioner.

Air blower means for the airconditioner preferably has a spigot delivery and adapted to be received by an aperture in said platform, the top of said duct means. In some instances it is desirable that such a spigot delivery end should be free to receive ductwork.

The base may include a second, perimetric, platform for supporting the lower ends of the side panels, a perimetric flange to restrict the side panels against outward movement and a water sump. The top may similarly be provided with a perimetric flange to restrict the upper ends of the side panels against outward movement.

A pump will normally be used to pump water from the sump to the trough and as there is a tendency for salt build-up to occur in evaporative airconditioners it is preferred that some of the water in the sump is continuously replaced by fresh water. This may be achieved by bleeding off some of the water pumped by the pump and by continuously supplying fresh water to the sump. In this respect the supply of fresh water to the sump is desirably achieved by a float operated valve.

Most preferably the stiles are made of fibre reinforced synthetic plastics materials but they could be made by pressing of metal or extrusion.

Three specific constructions of evaporative airconditioners and panels of which they are comprised will now be described with the aid of the accompanying drawings in which.

Figure 11:
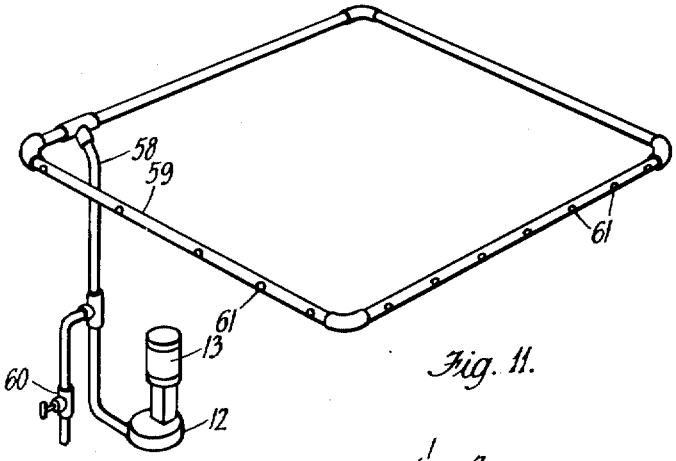
Figure 10:
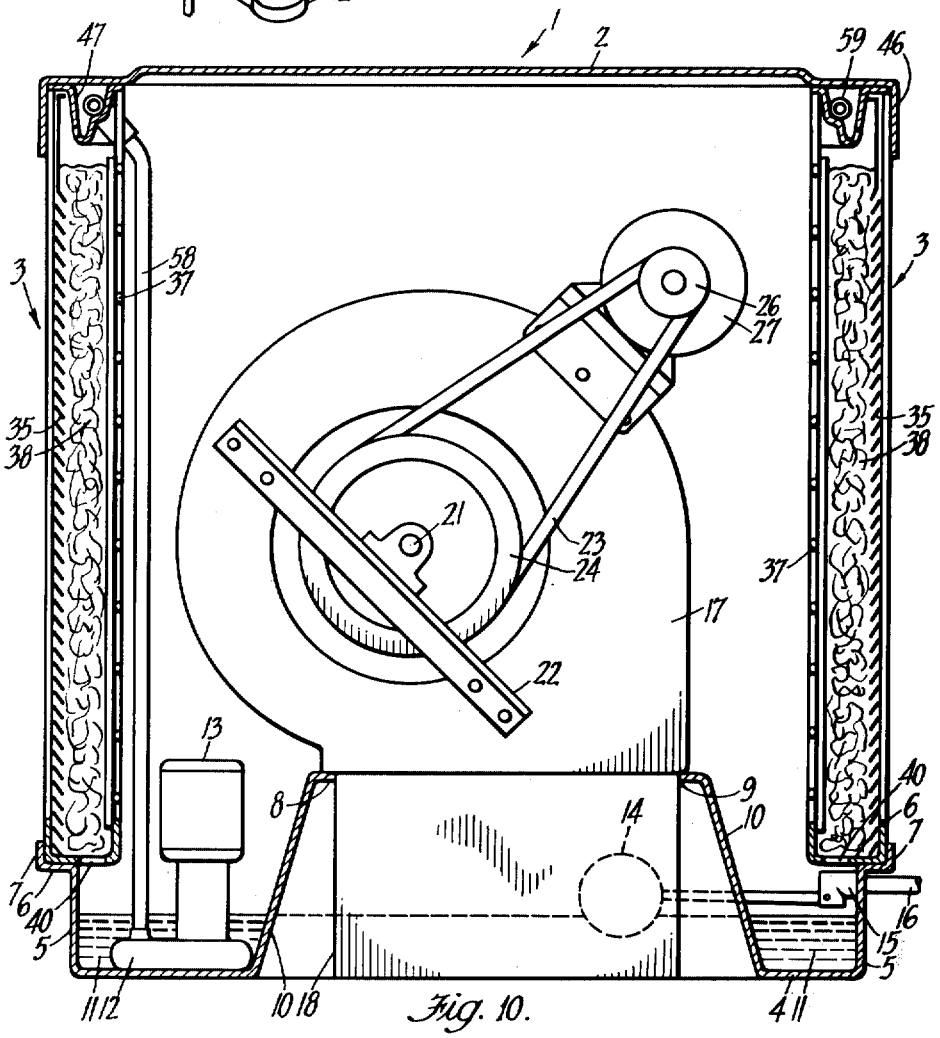
FIG. 10 is a vertical cross-section through the airconditioner of FIGS. 1 – 3.

FIG. 11 is a detail of part of the airconditioner of FIGS. 1 – 3 and 10 and which part is also used in the airconditioner of FIGS. 4 – 6 and 13, and 16 – 18.

Figure 1:
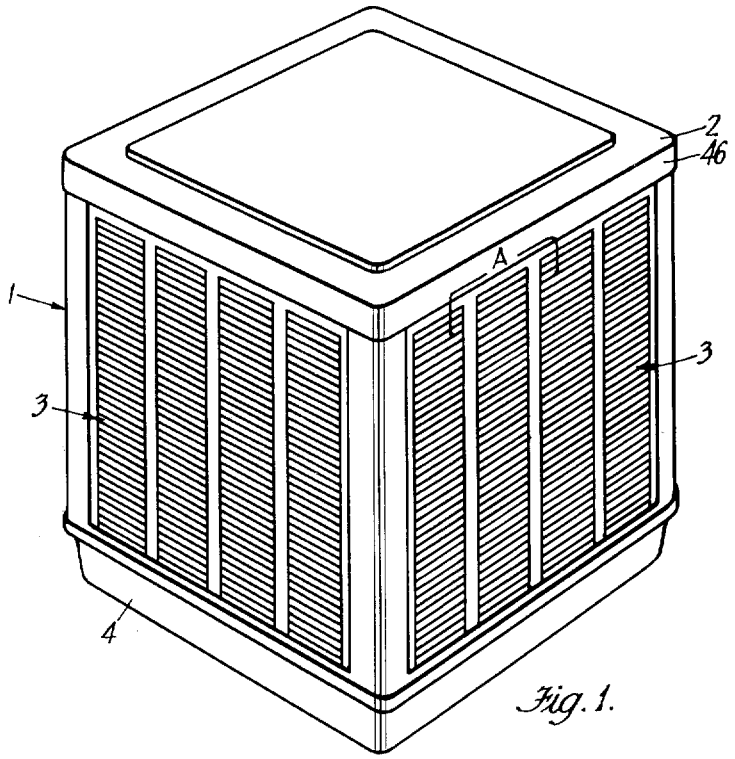
FIG. 1 is a perspective view from above of a bottom delivery evaporative airconditioner.
Figure 2:
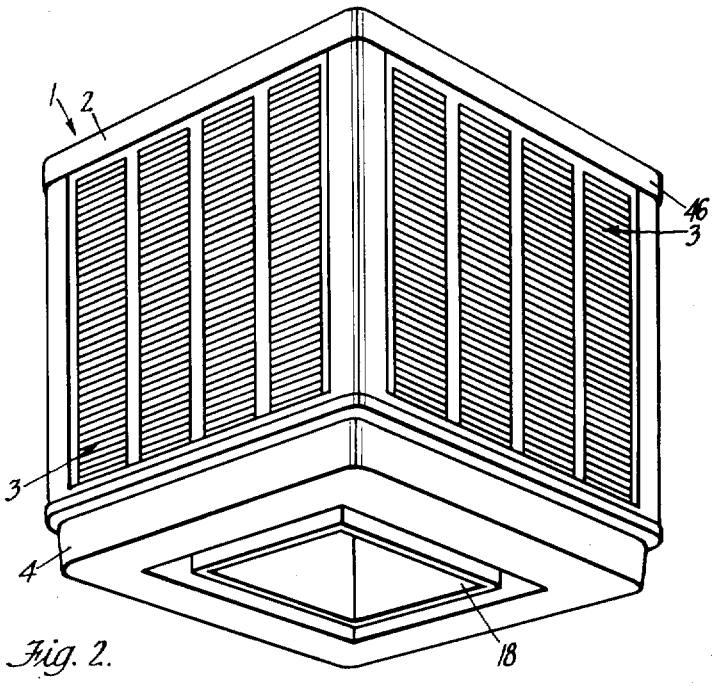
FIG. 2 is a perspective view from beneath of the airconditioner of FIG. 1.
Figure 3:
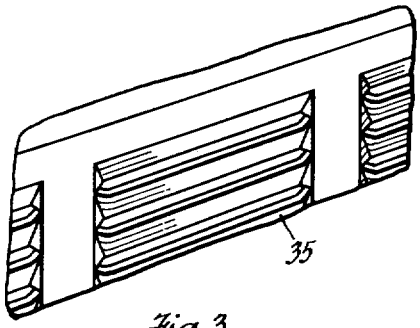
FIG. 3 is a detail of part of the airconditioner of FIG. 1.
Figure 6:
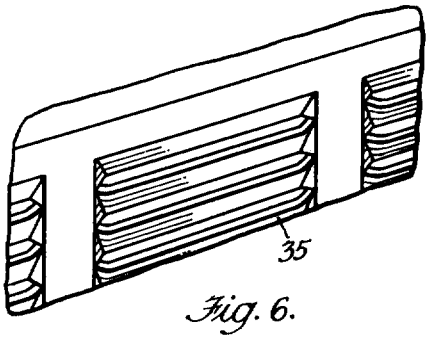
FIG. 6 is a detail of part of the airconditioner of FIG. 4.
Figure 13:
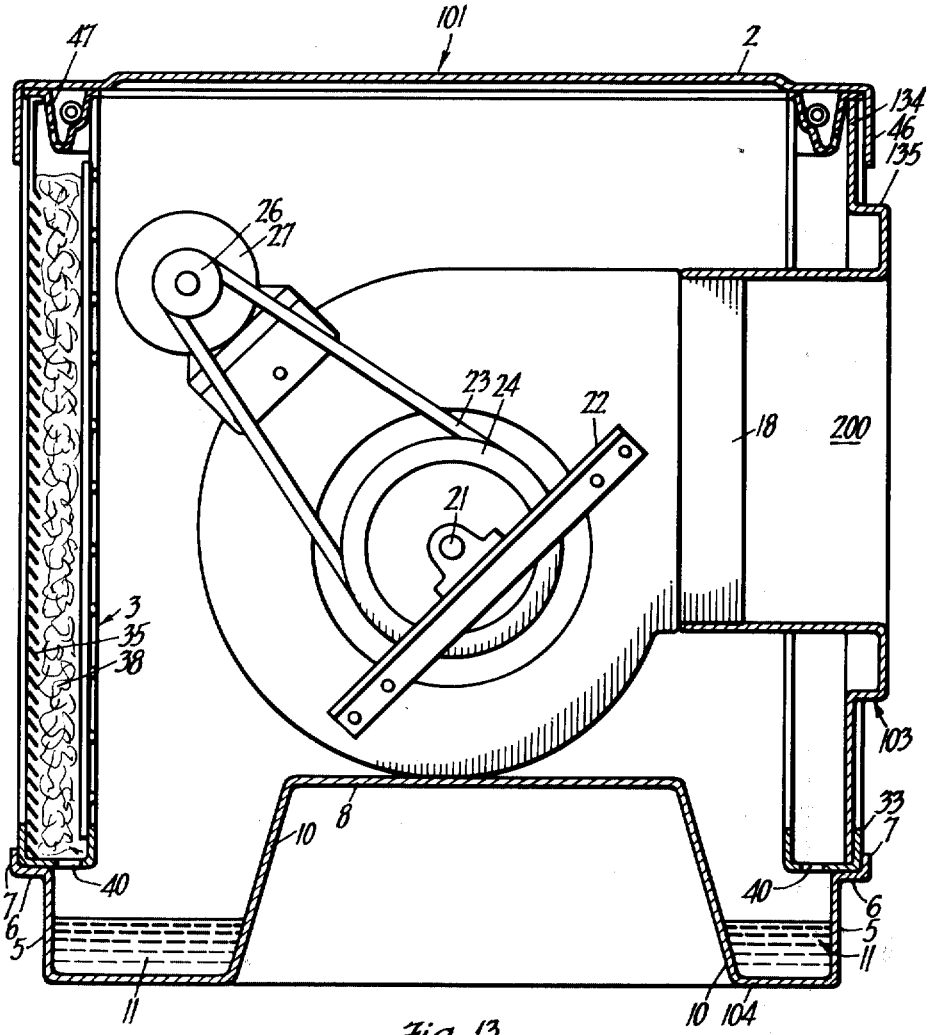
Figure 4:
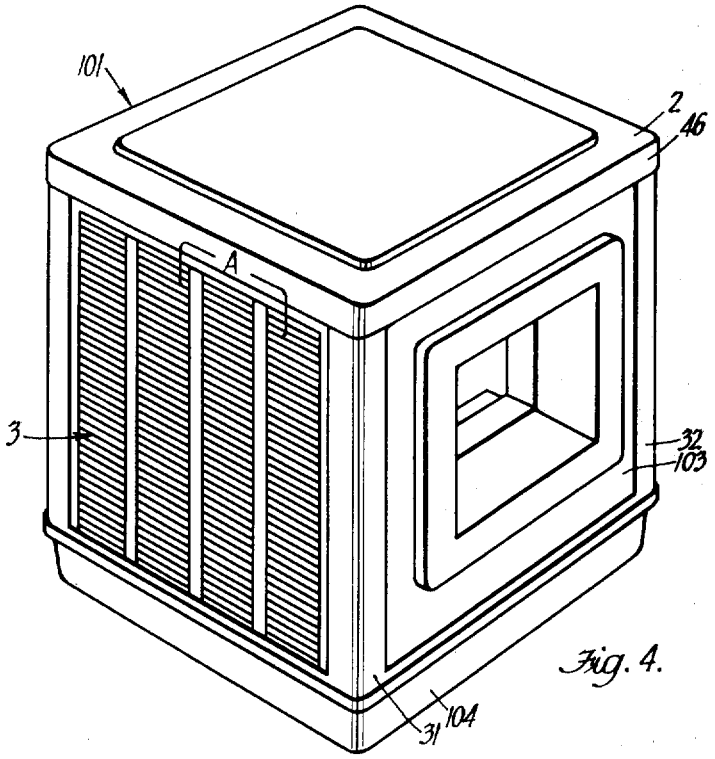
FIG. 4 is a perspective view from above of a side delivery evaporative airconditioner.
Figure 5:
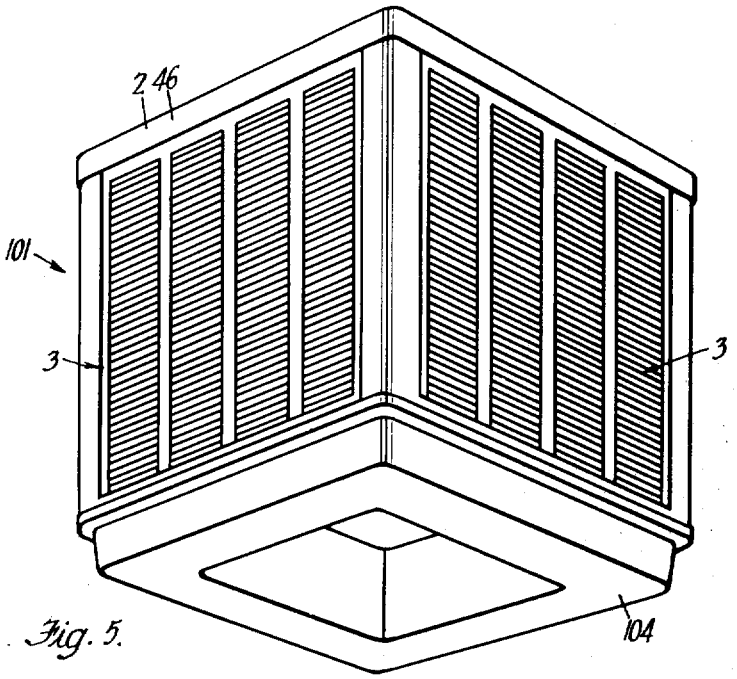
FIG. 5 is a perspective view from beneath of the airconditioner of FIG. 4.
Figure 18:
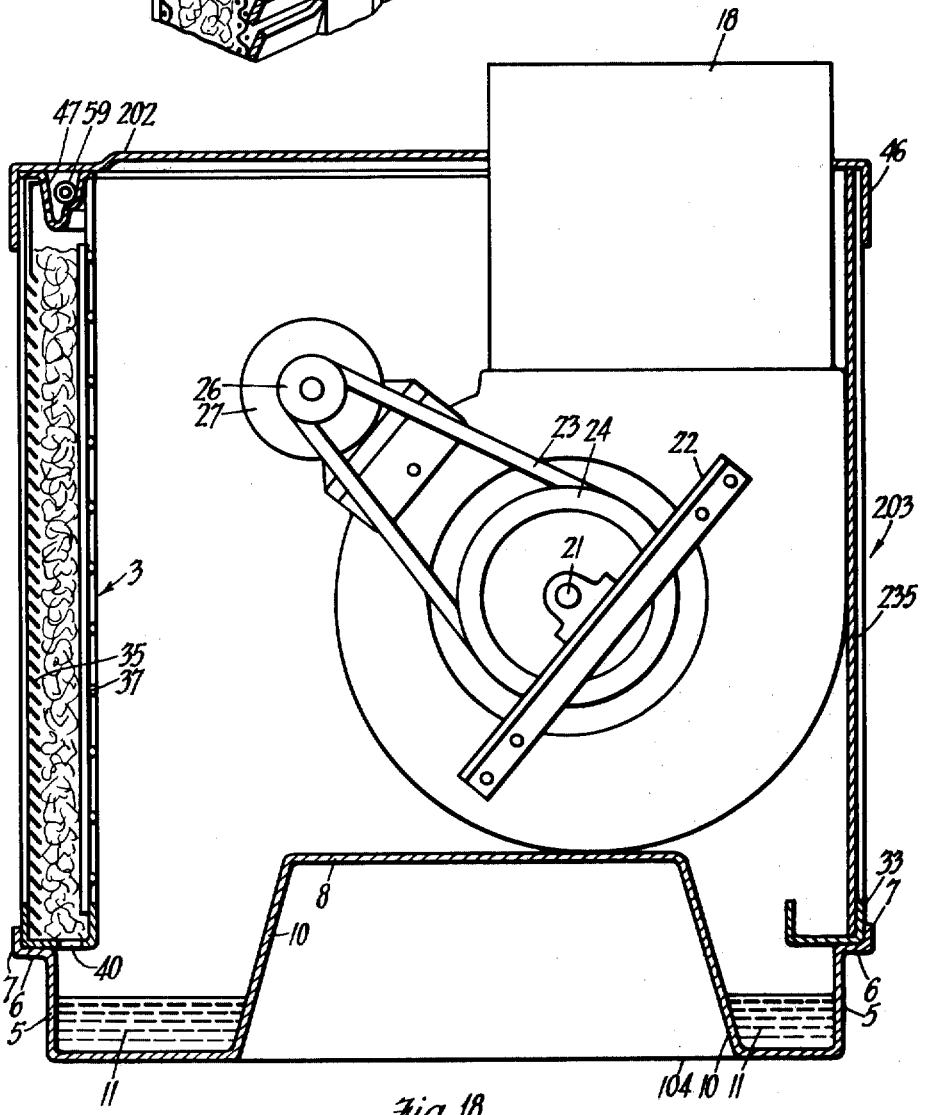
Figure 12:
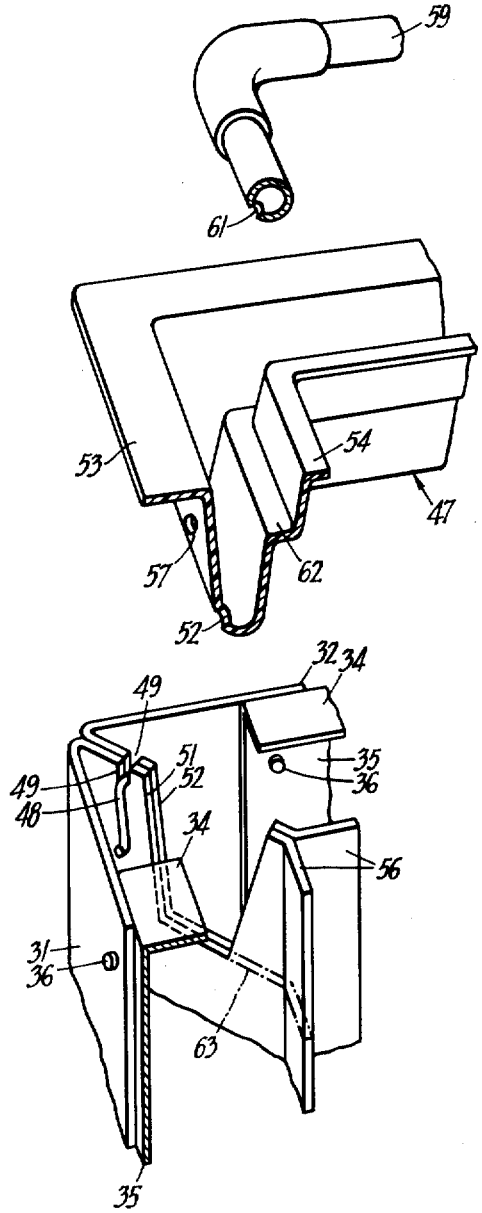
Figure 15:
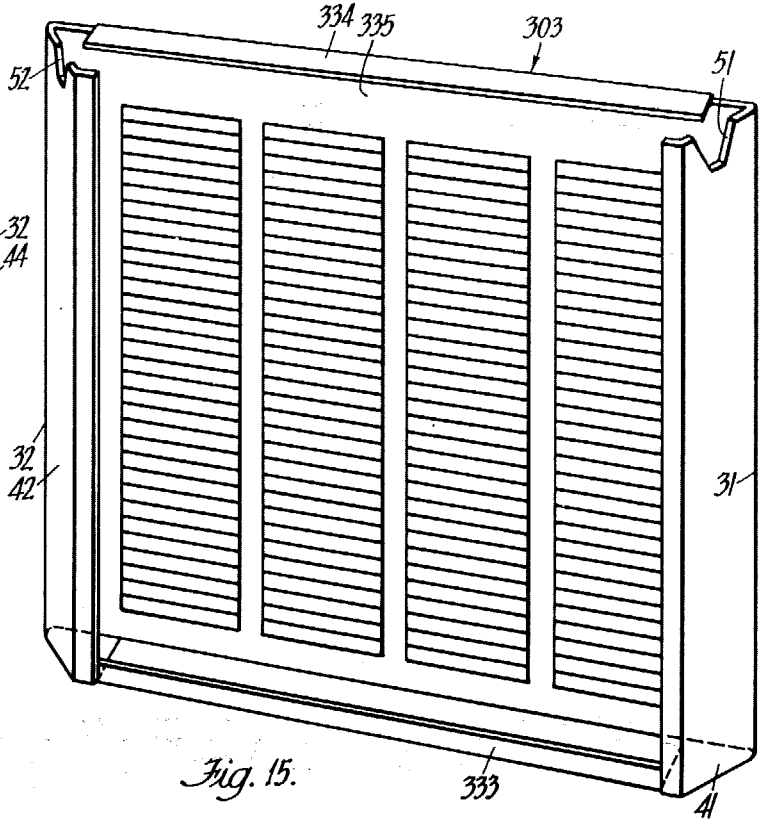
Figure 14:
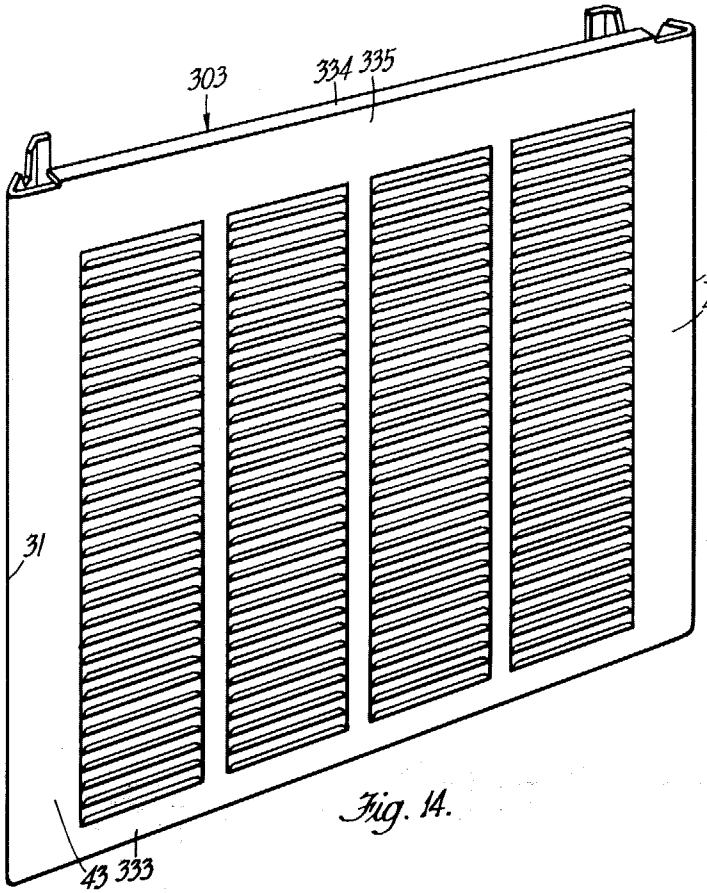
Figure 16:
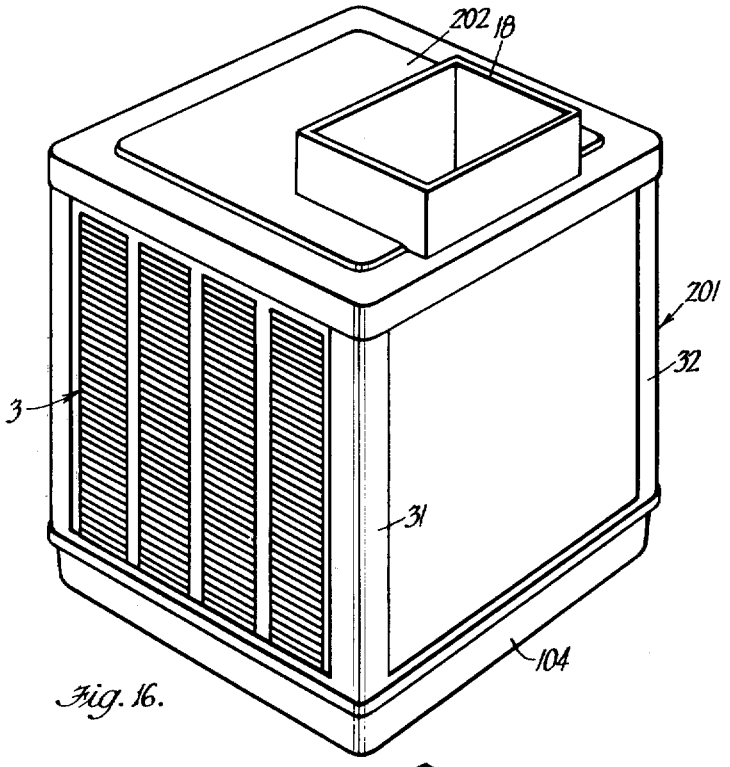
Figure 17:
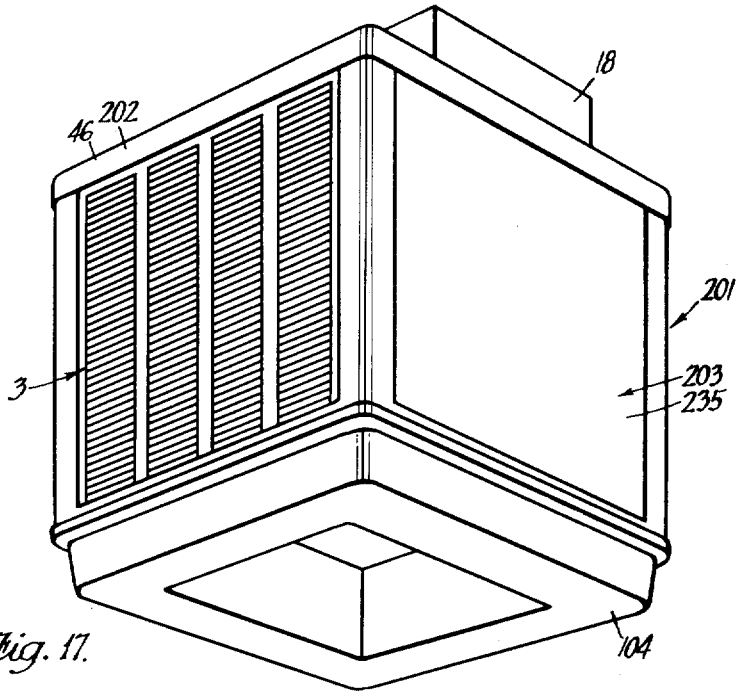

FIG. 12 is an exploded perspective detail of parts of the airconditioner of FIGS. 1 – 3 which parts are also used in the aircondtioner of FIGS. 4 – 6 an 13, and 16 – 18, FIG. 13 is a vertical cross-section through the airconditioner of FIGS. 4 – 6 and 13, FIG. 14 is a front perspective view of an alternative panel, FIG. 15 is a rear perspective view of the panel shown in FIG. 14, FIG. 16 is a perspective view from above of a top delivery evaporative airconditioner, FIG. 17 is a perspective view from beneath of the airconditioner of FIG. 16, and FIG. 18 is a vertical cross-section through the airconditioner of FIGS. 16 – 17.

The airconditioner 1 shown in FIGS. 1 – 3 and 10 comprises a top 2, four side panels 3 and a base 4.

The base 4 has an upstanding wall 5 which supports a step 6 and an upstanding flange 7. The base 4 also has a platform 8 which is apertured at 9 and which is supported by a wall 10. The walls 5 and 10 serve to define a sump 11 within which water is held. The base also supports a pump 12 driven by an electric motor 13 and a float (14) operated valve (15) which is connected, in use, to a water supply by means of pipe 16.

The step 6 serves to support the panels 3 and the flange 7 serves to prevent outward movement of the panels 3 at the bottom thereof.

Supported by the platform 8 is a scroll 17 which has a spigot 18 which projects through the aperture 9. The scroll 17 supports a tangential flow fan by means of bearings 21 carried by a bracket 22 bolted to the scroll. The tangential flow fan is drivable by means of a belt 23 through pulleys 24 and 26 from an electric motor 27 which is also bolted to the scroll 17.

The panels 3 (see FIGS. 7 – 9) each comprise two stiles 31 and 32, a bottom rail 33 and a top rail 34. The top rail 34 is formed as a flange on a facing in-fill louvred sheet 35 and the sheet 35 is secured to the stiles 31 and 32 by means of rivets 36. The stiles 31 and 32 and bottom rail 33 support a coarse mesh 37 and between the coarse mesh 37, facing sheet 35, bottom rail 33 and stiles 31 and 32 is a water absorbent material 38 enclosed in a fine mesh 39.

As the water absorbent material may be used any material suitable for carrying water for evaporation therefrom. A commonly used material is pine shavings.

Water drainage holes 40 are provided in the bottom rails 33.

The configuration of the stiles 31 and 32 of the panels 3 is important. It will be observed that the stiles have faces 41 and 42 which lie at 45° to faces 43 and 44; i.e. the side edges of the stiles 31 and 32 are mitred at 45°.

This mitring of the side edges enables easy assembling of the panels to one another and avoids the need of providing the airconditioner with a frame to which the panels 3 may be secured.

Further, the mitring of the side edges serves to inhibit inward movement of the panels 3 at the top and bottom thereof as the panels will tend to act against one another to inhibit such movement.

Inhibition of outward movement of the panels 3 at the top thereof is achieved by the top 2 which has a dependent skirt 46, a trough 47 (to be described in detail later in this specification) and most particularly, by clips 48.

The clips 48 are bent wire clips and fit into slots 49 in the stiles 31 and 32 as shown in FIG. 12. By themselves they are sufficient to stabilize the panels 3 at the tops thereof and the additional stabilization by the top 2 is not strictly necessary and that by the trough 47 can be considered to be available as an alternative and/or additional and/or useful during assembly and disassembly.

The trough 47 has a generally square outside and inside perimeter when viewed in plan so that the trough extends around a space.

It will be observed that the upper ends of the stiles 31 and 32 are notched at 51 and 52 and these notches serve to locate the trough in position and the trough 47, in turn, will serve to locate the upper ends of the stiles.

In addition, the trough has flanges 53 and 54 which are supported by the top rail 34 and the stiles 31 and 32 at 56.

The trough 47 has holes 57 in it to allow water to trickle from it onto the water absorbent material 38.

Water is supplied to the trough 47 by means of the pump 12 via a hose 58 to a water distribution tube 59 which is best shown in FIG. 11. The water distribution tube 59 has holes 61 therein and it is to be noted that the holes 61 remote from the hose 58 are more closely spaced (and/or of larger size) than those adjacent to hose 58 to compensate for pressure drop in tube 59.

A bleed tap 60 is connected to hose 58 and will normally be left slightly open to bleed off some water so that fresh water will continuously be supplied by the float operated valve. Thus the sump should not become fouled by salt build-up. The tap 60 may conveniently be moulded into the base 4.

The water distribution tube 59 is supported on a step 62 in trough 47.

As mentioned, the panels 3 are notched at 51 and 52 to locate the trough 47 but as it will be desirable to provide access to the interior of the airconditioner, for example, for servicing the electric motor, the fan, the pump or the valve, it is to be noted that the stiles 31 and 32 of one of the panels are cut along the dash-dot line 63. Thus, by removing the lid 2 and the clips 48 securing that particular panel, that particular panel may be removed without disturbing or being restricted by the trough 47 or the other panels 3 of the airconditioner. Reassembly is carried out in reverse manner.

In use of the airconditioner described with respect to FIGS. 1 – 3, 7 – 9 and 10 – 12, a water supply is connected to the pipe 16 and by means of the float (14) operated valve 15 the sump 11 is caused to fill with water to a predetermined level.

When a demand for cool air is received, such as by the operation of manual or automatic controls, the pump 12 is driven by the motor 13 to cause water to pass up the hose 58 to the tube 59 with some bleed through tap 60, thence to the trough 47 and from there to the water absorbent material 38. The tangential flow fan is also caused to be driven by the motor 27 and this will cause air to be drawn from the exterior of the airconditioner, through the facing sheet 36, through the water absorbent material 38 (thereby evaporating water therefrom, humidifying the air and cooling the air) into the interior of the airconditioner. From there the humidified and cooled air will pass through the tangential flow fan and out of the airconditioner via the spigot 18 which may be connected direct to a space to be conditioned or to ductwork for distributing the humidified and cooled air.

Any excess water supplied to the water absorbent material 38 may return to the sump 11 via the holes 40 in bottom rails 33.

The airconditioner described with respect to FIGS. 1 – 3, 7 – 9, and 10 – 12 of the drawings is conveniently principally made, insofar as its structural parts are concerned, from fibre reinforced synthetic plastics resins although metal pressings or extrusions could be extensively used.

However, it is currently preferred to use fibre reinforced synthetic plastics as these enable the base 4, the scroll 17 and lid 2 to be easily moulded and also enables the stiles 31 and 32 to be moulded. The sheet 36 is, however, most conveniently made by stamping sheet aluminium.

In the manufacture of the airconditioner described with respect to FIGS. 1 – 3, 7 – 9, and 10 – 12 of the drawings, the tangential flow fan and motor 27 may be assembled to the scroll 17 which may be then brought into relation with the aperture 9 and, if desired, the scroll 17 can be bonded to the platform 8.

The pump and its electric motor and the float (14) operated valve 15 may be assembled to the bottom 4 at any convenient stage.

Assemblage of the panels 3 to the airconditioner is particularly easy; it being only necessary to locate them on the step 6 and inside of the flange 7 and then to locate and secure them at their tops with the clips 48.

The trough 47 is positioned merely by lowering it into place and it is to be noted that the trough 47 can be used to temporarily locate the tops of the panels 3 before the clips are positioned.

Other manufacturing and/or assemblage details are not given as they are considered to be of minor importance.

The airconditioner 101 shown in FIGS. 4 – 6 and 13 is very similar to that shown in FIGS. 1 – 3, 7 – 9, and 10 – 12 and it is to be noted that the parts shown in FIGS. 7 – 9 and 11 – 12 are common and that in FIGS. 4 – 6 and 13 like reference numberals are used to denote like parts.

Only the significant differences between airconditioners 1 and 101 will be described.

Firstly, the airconditioner 101 has a base 104 which is similar to base 4 excepting that aperture 9 is omitted and the scroll 17 is partly supported by platform 8.

Next, airconditioner 101 is designed for side delivery and for this reason one of the panels 3 of airconditioner 1 is replaced by a panel 103.

The panel 103 has stiles 31 and 32 and a bottom rail 33 the same as panel 3 but sheet 35 is replaced by a facing 135 which mounts spigot end 18 of the scroll 17 and serves to provide a side outlet 200 for conditioned air and which has an upper flange 134 for supporting trough 47.

In all other respects airconditioner 101 is substantially the same as airconditioner 1. Indeed, the only significant difference is the base 104, which may be made from the same mould as base 4 and panel 103 which has many parts in common with panel 3.

Thus it will be realized that a manufacturer will not have substantial difficulty in shifing production from airconditioners in accordance with FIGS. 1 – 3 and 10 to airconditioners in accordance with FIGS. 4 – 6 and 13.

Figure 9:
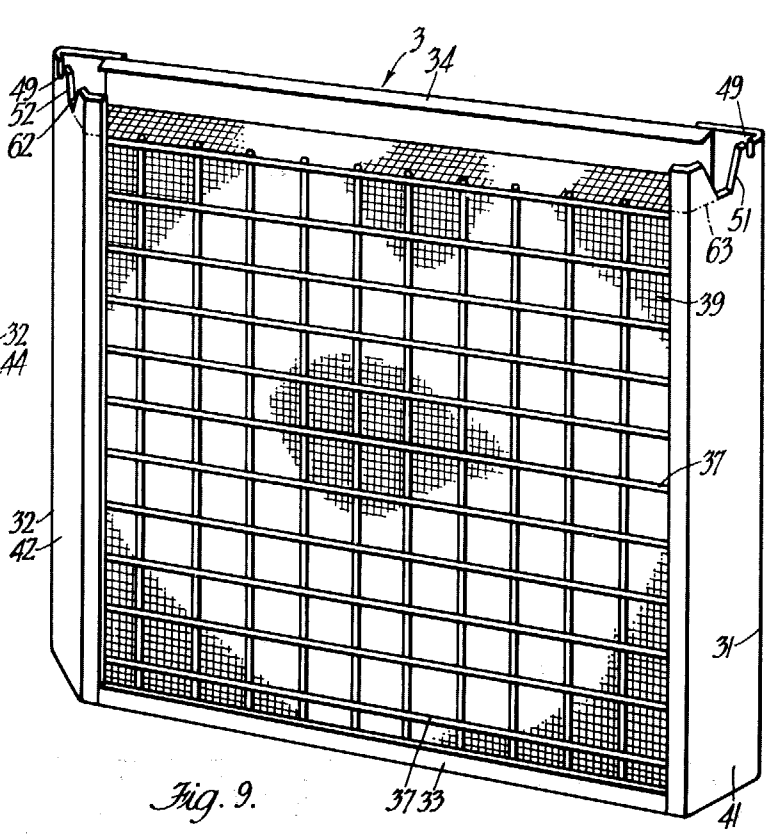
FIG. 9 is a rear perspective view of the panel of FIG. 7.
Figure 7:
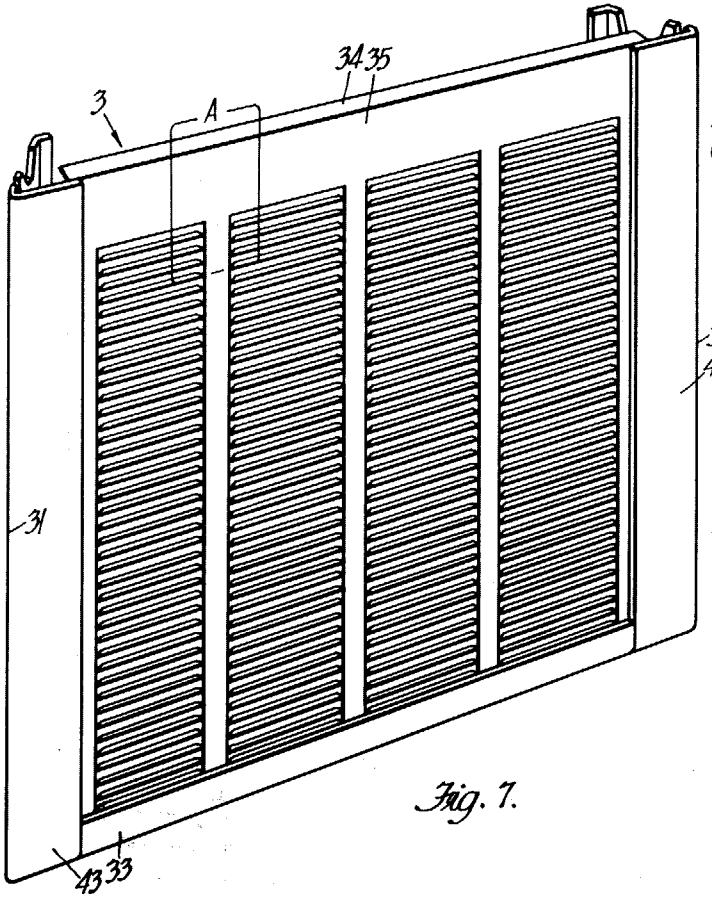
FIG. 7 is a front perspective view of one of the panels.
Figure 8:
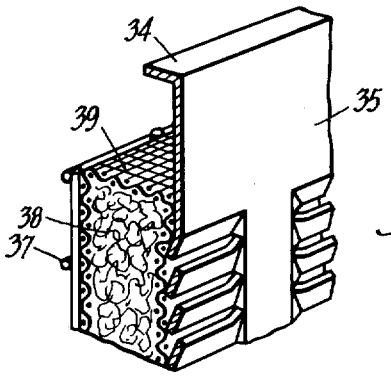
FIG. 8 is a detail of part of the panel shown in FIG. 7.

The panel 303 shown in FIGS. 14 and 15 is similar to panel 3 shown in FIGS. 7 – 9 and like numerals denote like parts. Only significant difference of panel 303 from panel 3 will be discussed.

Panel 303 is shown without mesh 37, material 38 and fine mesh 39 but these would be present in use.

Panel 303 does not have the bottom rail 33, top rail 34 and sheet 35 of panel 3 formed as separate parts to the stiles 31 and 32 but in lieu is a unitary construction made from a single sheet of synthetic plastics material or metal by moulding, folding, pressing or stamping and thus has integrally formed bottom rail 333, top rail 334 and sheet 35. In all other respects panel 303 is substantially the same as panel 3.

The airconditioner 201 shown in FIGS. 16 – 18 is very similar to those shown in FIGS. 1 – 3, 7 – 9 and 10 – 12, and FIGS. 4 – 6 and 13 and like reference numerals denote like parts.

Only the significant differences between airconditioners 1, 101 and 201 will be described.

Airconditioner 201 is designed for top delivery and to support the scroll 17 one of the panels 3 of airconditioner 1 is replaced by a panel 203.

The panel 203 has stiles 31 and 32 and a bottom rail 33 the same as panel 3 but sheet 35 is replaced by a sheet 235 to which the scroll 17 is attached.

Further, airconditioner 201 has a top 202 which has an opening therein through which the spigot end 18 of the scroll extends so that airconditioner 201 is a top delivery airconditioner.

The trough 47 also extends on all sides of airconditioner 201 except the side of panel 203.

In all other respects airconditioner 101 is substantially the same as airconditioners 1 and 101.

Thus it will be realized that a manufacturer will not have substantial difficulty in shifting production from airconditioners in accordance with FIGS. 1 – 3 and 10 or 4 – 6 and 13 to airconditioners in accordance with FIGS. 16 – 18.

Particular advantages of the panels 3 and 103 and 203 are that they are easy to manufacture, are standardized, share common parts and enable a frameless airconditioner to be made simply and cheaply.

In a modification, the slots 49 are omitted as it has been found that the clips 48 will adequately secure the panels until such time as the lid 2 is located.

In another modification, screws, such as Teks screws, are passed through step 6 into metal plates located at the bottom of stiles 31 and 32. In an alternative, screws pass through flange 7.

Modifications and adaptions may be made to the above described constructions without departing from the spirit and scope of this invention which includes every novel feature and combination of features disclosed herein.

We claim:

1. An evaporative airconditioner comprising:

a base panel, a top panel, side panels which include stiles having mitred side edges and wherein stiles of adjacent side panels abut and close sides of the airconditioner;

wherein the base panel includes a bottom, a first platform above the bottom, a second, perimetric, platform supporting the lower ends of the side panels and inner and outer walls respectively supporting the first and second platforms and with the bottom defining an annular water sump;

wherein the second platform has a perimetric flange restricting the lower ends of the side panels against outward movement;

air blower means supported on the first platform;

an outlet from the air blower means;

an aperture in one of the base, top and side panels in register with said outlet;

a water trough;

wherein the upper ends of the side panels and the water trough are complimentarily formed whereby the trough stabilizes the upper ends of the side panels and whereby the side panels support and locate the trough;

a water absorbent material carried by at least one of the side panels; and pump means operative in use to pump water from the sump to the trough for distribution to said material for evaporation therefrom.

2. An evaporative airconditioner as claimed in claim 1, wherein the base is an integrally formed plastics moulding.

3. An evaporative airconditioner as claimed in claim 1, wherein said aperture is surrounded by a socket and the blower means includes a spigot receivable in that socket.

4. An evaporative airconditioner as claimed in claim 1, wherein the upper ends of the side panels and the trough are U-shaped in cross-section.

5. An evaporative airconditioner as claimed in claim 1, and including clip means holding adjacent side panels together.

6. An evaporative airconditioner as claimed in claim 1, wherein the clips are located in slots in the upper ends of the panels.

7. An evaporative airconditioner as claimed in claim 1, wherein the top panel includes a perimetric flange restricting the upper ends of the side panels against outward movement.

* * * * *